US005597970A

United States Patent [19]

Sato et al.

[11] Patent Number: 5,597,970

[45] Date of Patent: Jan. 28, 1997

[54] WAVEFORM PROCESSING APPARATUS AND AN ELECTRONIC MUSICAL INSTRUMENT USING THE OUTPUT WAVEFORM THEREOF

[75] Inventors: Hiroshi Sato; Kaoru Matsunaga, both of Shizuoka-ken, Japan

[73] Assignee: Kabushiki Kaisha Kawai Gakki Seisakusho, Japan

[21] Appl. No.: 327,191

[22] Filed: Oct. 21, 1994

[30] Foreign Application Priority Data

Oct. 28, 1993 [JP] Japan ..... 5-292565

[51] Int. Cl.[6] ..... G10H 1/08; G10H 1/12; G10H 7/02

[52] U.S. Cl. ..... 84/604; 84/625; 84/660; 84/661; 84/DIG. 9

[58] Field of Search ..... 84/604–607, 622–625, 84/660, 661, 699, 700, 736, DIG. 9

[56] References Cited

U.S. PATENT DOCUMENTS 5,018,429 5/1991 Yamaya et al. ..... 84/622
5,025,700 6/1991 Morikawa et al. ..... 84/DIG. 9
5,202,528 4/1993 Iwaooji ..... 84/661 X
5,442,130 8/1995 Kitayama et al. ..... 84/661

*Primary Examiner*—Stanley J. Witkowski
*Attorney, Agent, or Firm*—Westman, Champlin & Kelly, P.A.

[57] ABSTRACT

In the waveform processing apparatus of the present invention, an original sound signal is divided into a plurality of bands, parameters such as amplitude and frequency are extracted for each band, and correction is made so that the amount of deviation of the parameters from the mean value thereof is gradually decreased to zero from a certain time to the time when the repetition period begins, whereby a musical tone signal is re-synthesized based on the corrected parameters. The electronic musical instrument which stores the waveforms processed by the apparatus of the present invention generates musical tones having more natural tone color change.

11 Claims, 6 Drawing Sheets

WAVEFORM PROCESSING APPARATUS AND AN ELECTRONIC MUSICAL INSTRUMENT USING THE OUTPUT WAVEFORM THEREOF

BACKGROUND OF THE INVENTION

1. Field of the Invention

The present invention is related to a waveform processing apparatus and an electronic musical instrument in which the waveform processed by the apparatus is stored in a waveform memory, and particularly to correction of waveform data when the waveform is repeatedly read out from the waveform memory.

2. Description of the Prior Art

In the conventional electronic musical instrument, there were methods in which musical tones are stored in a waveform memory, and read out based on play information such as key-on to produce musical tone signals. Among them, there was a method in which to provide delicate change of tone color in the attack portion immediately after a key-on and the succeeding decay and sustain portions, the original tone of a musical instrument is recorded from the start to the end of tone generation and stored in a waveform memory. In this case, since the latter-half waveform had little tone color change, there was a method in which the capacity of waveform memory was saved by repeatedly reading out the same waveform section after the elapse of a certain period of time.

In natural sound, generally both the frequency and amplitude components are changing with time. However, in the conventional electronic musical instrument as described above, there was a problem that the spectral change with time suddenly disappears when the period for repetition reading from the waveform memory is entered, thus providing an unnatural feeling.

SUMMARY OF THE INVENTION

It is the object to the present invention to provide a waveform processing apparatus which can create waveform data for allowing the tone color to continuously and naturally change before and after entering the period for repetitive waveform reading, and an electronic musical instrument in which more natural tone color change is achieved by using the waveform processed by the apparatus.

The present invention is characterized by an apparatus in which an original tone signal is divided into a plurality of bands, the change of parameters such as amplitude and frequency is corrected for each band so that it gradually decreases to zero from a certain time to the time when a repetition period begins, and a musical tone signal is resynthesized based on the corrected parameters; and an electronic musical instrument in which waveform data processed by the apparatus is stored.

In the present invention, since the original tone is separately processed for each band by such means, any parameter change can be accurately controlled, enabling arbitrary control of the way in which the tone color changes. In consequence, it is possible to form a waveform which allows the degree of change in the tone color to smoothly vary before and after the entrance to the repetition period, enabling the achievement of an electronic musical instrument which provides a more natural tone color change.

DETAILED DESCRIPTION OF THE PREFERRED EMBODIMENT

First, an embodiment of the electronic musical instrument to which the present invention is applied is described.

Figure 2:
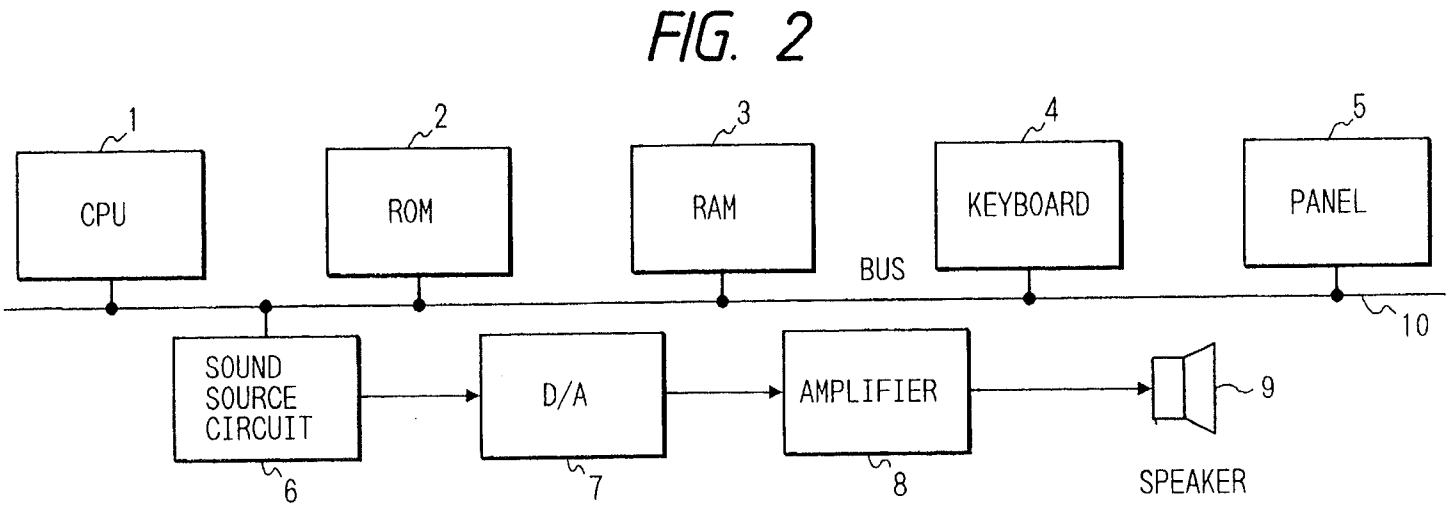
FIG. 2 is a block diagram representing the configuration of an electronic musical instrument.

FIG. 2 is a block diagram representing the configuration of the electronic musical instrument to which the present invention is applied. A CPU 1 performs the overall control of the electronic musical instrument including the well-known key assign processing and tone generation processing by the program stored in a ROM 2. In ROM 2, in addition to a control program, for instance, various tables, musical piece data for automatic playing, various tone color data, etc. are stored. A RAM 3 is used as a work area the CPU 1, and in addition, it stores various control data such as a key assign table and a sound source control information table. The RAM 3 may be battery-backed up. A keyboard 4 consists of, for instance, a plurality of keys each having two switches, and a keyboard interface circuit, not shown, scans the switches of each key under control of the CPU 1.

A panel 5 comprises, for instance, various switches on the panel such as selector switches for tone color and rhythm pattern, and ten key switches for inputting numerical values, a display device such as an LED, and a panel interface circuit. A sound source circuit 6 can generate, for instance, independent digital musical tone signals of 16 channels by a time-sharing multiple processing under control of the CPU 1. A D/A converter 7 converts the digital g signals output from the sound source circuit 6 to analog signals. An amplifier 8 amplifies the analog musical tone signals to cause a speaker 9 to make sound. A bus 10 interconnects each circuit in the electronic musical instrument. In addition to this, MIDI interface circuit, etc. may be provided.

Figure 3:
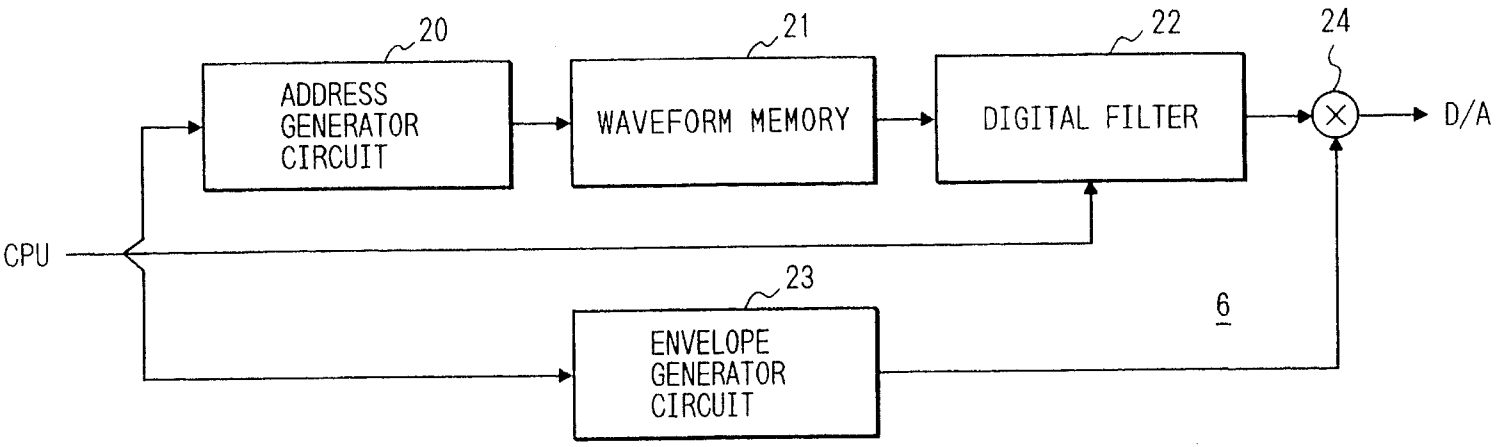
FIG. 3 is a block diagram showing the configuration of the sound source circuit 6 of FIG. 2.

FIG. 3 is a block diagram showing the configuration of the sound source circuit 6 of FIG. 2. An address generator circuit 20 includes an accumulator for each channel for accumulating address interval information corresponding to the pitch of a depressed key, thereby generating, for instance, a read address corresponding to a waveform memory for each sampling period. In addition, if waveform data is stored only to a predetermined length in a manner to be described later, the address is controlled so as to repeatedly read out the waveform data in the last predetermined range. A waveform memory 21 is a ROM or RAM for storing waveform data formed in a manner to be described later, in which different waveform data is stored for each tone color and each pitch range.

A digital filter 22 controls tone color under control of the CPU 1. In addition, the frequency characteristics of the digital filter 22 may be controlled using an envelope generator. An envelope generator circuit 23 generates the envelope signal of a musical tone corresponding to tone color and touch information. A multiplier 24 multiplies the output signal of the digital filter 22 by the envelope signal, the output of the envelope generator circuit 23, thereby outputting a musical tone signal. The features of the present invention reside in the waveform data to be stored in the waveform memory.

Figure 4:
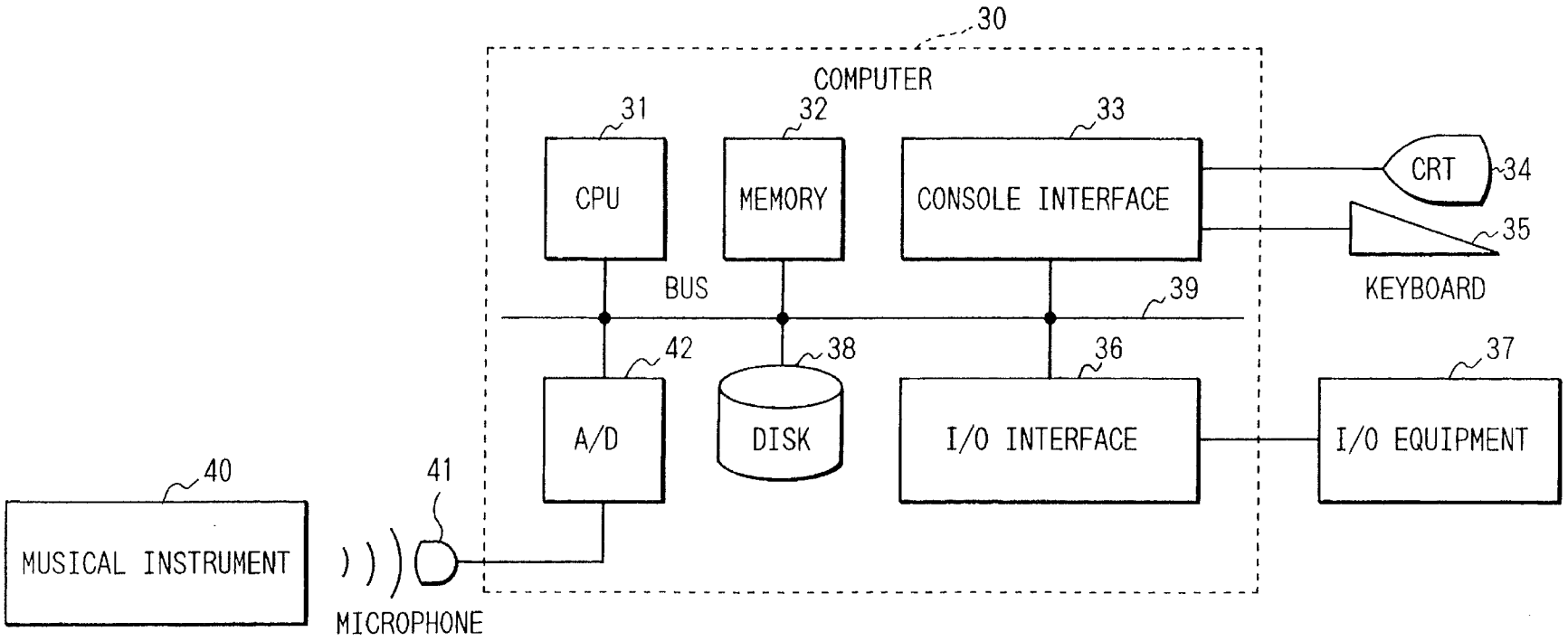
FIG. 4 is a block diagram showing the configuration of the waveform processing apparatus of the present invention.

Next, the waveform processing apparatus for creating data to be stored in the waveform memory is described. FIG. 4 is a block diagram showing the configuration of the waveform processing apparatus of the present invention. A waveform processing apparatus 30 is obtained by adding an A/D converter 42 for inputting the signal of a microphone to the conventional computer system, and building a program for the waveform processing in the computer. A CPU 31 executes various operations according to the program. In memory 32, the program and data are stored. A console interface 33 is an interface circuit for a CRT display 34 and a keyboard 35.

An I/O interface circuit 36 is an interface circuit between the computer system and various I/O equipment 37 such as a printer, a communication unit and a ROM writer. A disk 38 is to store the program and data files. A bus 39 interconnects each circuit in the system. A musical instrument 40 is to generate musical sound, a source of the waveform data for an electronic musical instrument. The musical tone generated from the musical instrument 40 is converted to an electric signal by a microphone 41, and further converted to a digital signal by an A/D converter 42, producing original sound data.

Figure 1:
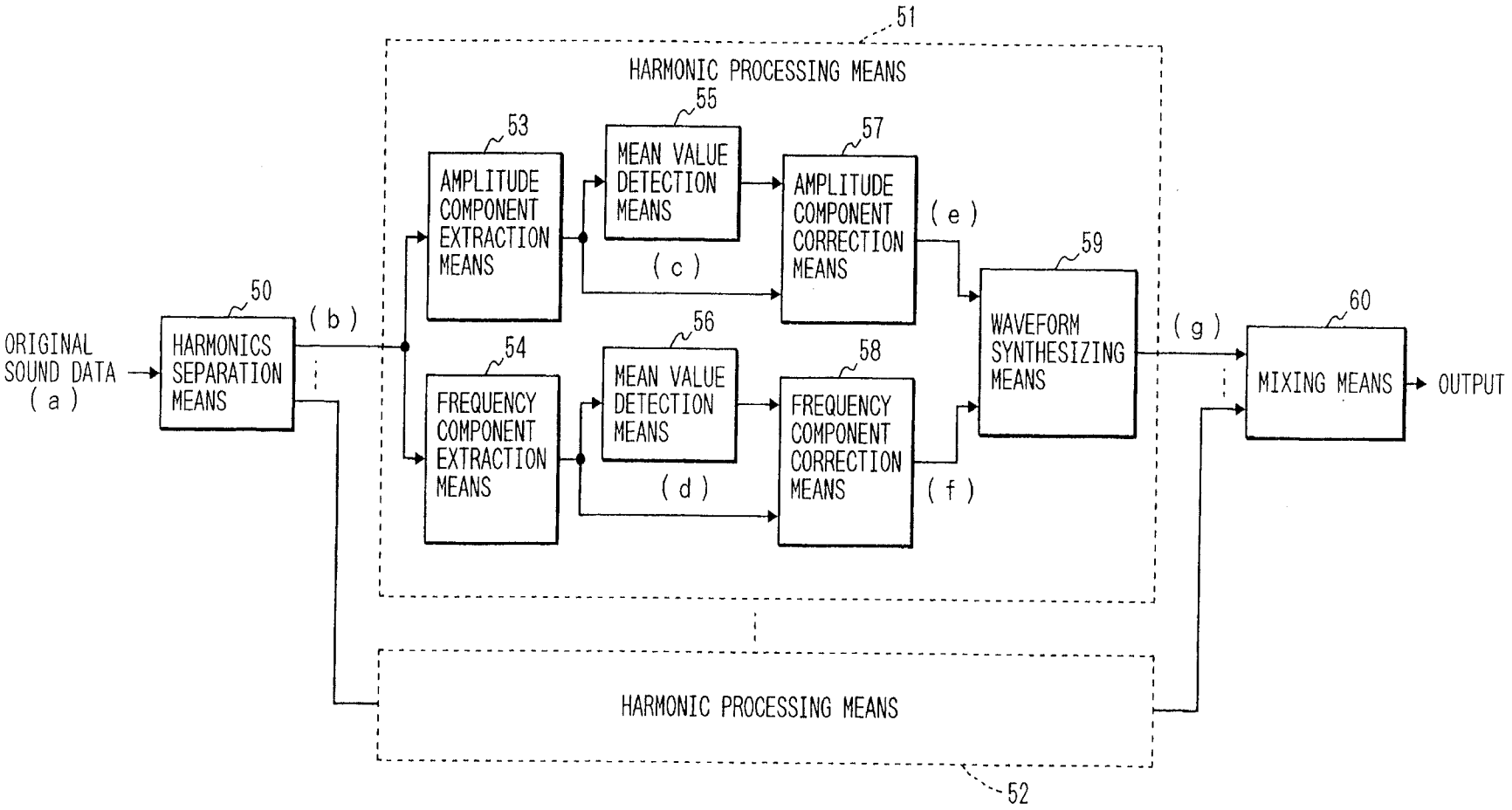
FIG. 1 is a functional block diagram showing the functions of the waveform processing apparatus according to the present invention.
Figure 5A:
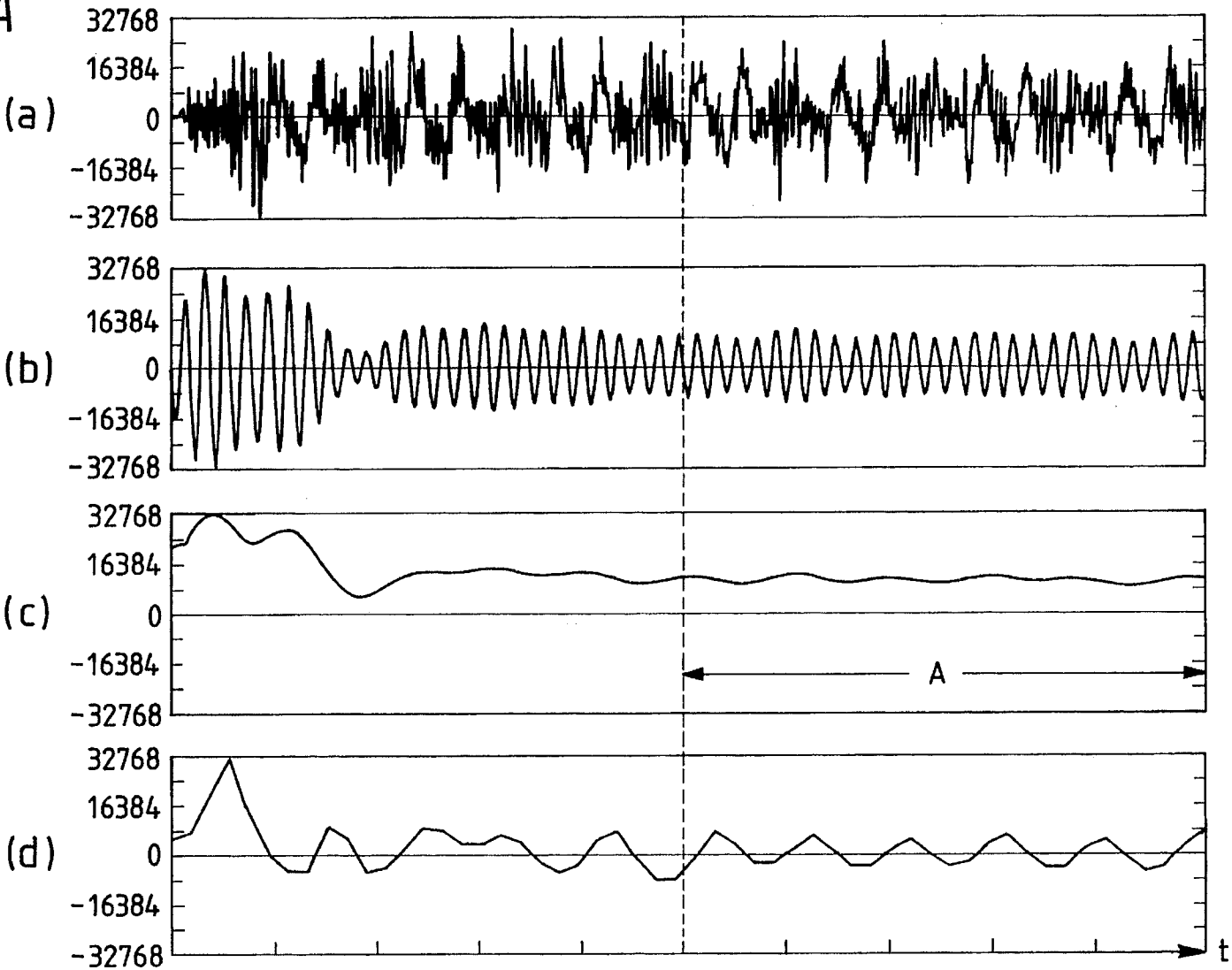
FIGS. 5A and 5B are waveform diagrams showing the signal waveforms in each waveform processing step of the present invention.

FIG. 1 is a functional block diagram showing the processing functions of the waveform processing apparatus of FIG. 4. A harmonics separation means 50 separates original sound data having a waveform as shown in FIG. 5A (a) into a plurality of harmonic components. In this processing, for instance, first, the frequency and level of each harmonic component are determined from the spectrum of the original sound obtained by a FFT or the like. Then, for harmonics whose levels are higher than a certain level, a harmonic component as shown in FIG. 5A (b) is independently extracted by a band-pass filter processing, respectively. The number of harmonic processing means 51 and 52 are equal to the number of the extracted harmonics, and each extracted harmonic is independently processed by the plurality of harmonic processing means 51 and 52.

An amplitude component extraction means 53 detects, for instance, the amplitude peaks of a harmonic signal, and outputs amplitude component data as shown in FIG. 5A (c) by connecting the peaks by a line. A frequency component extraction means 54 outputs frequency component data as shown in FIG. 5A (d), for instance, by determining the period from the interval between the zero-cross points of the harmonic signal, and calculating the reciprocal of it. Mean value detecting means 55 and 56 calculate the mean value of the amplitude component and the frequency component, respectively, for a predetermined range, for instance, the range A in FIG. 5A.

Figure 5B:
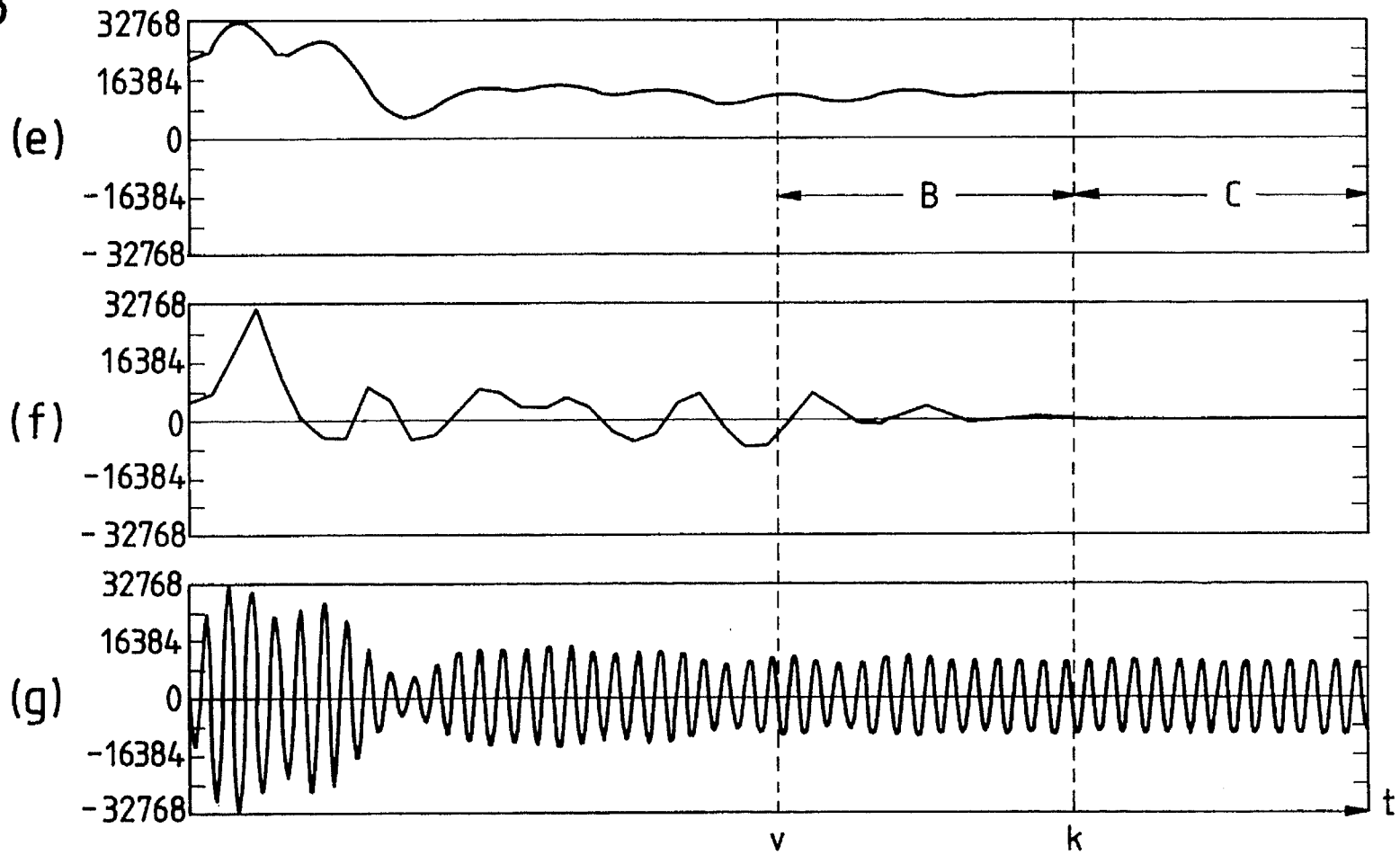

An amplitude component correction means 57 outputs corrected amplitude component data as shown in FIG. 5B (e) by correcting the amplitude component data so that the deviation of the amplitude data from the mean value is gradually decreased for a predetermined period (t: v to k), and so that the amplitude data becomes the mean value after a certain time (t=k). The range C (t>k) in FIG. 5B represents a range in which the waveform is repeatedly read out. Assuming that the amplitude component is a(t), the corrected amplitude component data is a'(t), and the mean value is A, the processing is shown by the following equations.

$$a'(t)=a(t)\ (t{:}0 \text{ to } v-1)$$

$$a'(t)=A+(a(t)-A)*(k-t)/(k-v)\ (t{:}\ v \text{ to } k-1)$$

$$a'(t)=A(t{:}\ k \text{ or after})$$

A frequency component correction means 58 also outputs corrected frequency component data as shown in FIG. 5B (f) by correcting the frequency component data so that the deviation of the frequency component from the mean value is gradually decreased for a predetermined period (t:v to k), and so that the frequency component data becomes the mean value after a certain time (t=k). Assuming that the frequency component data is f(t), the corrected frequency component data is f'(t), and the mean value is F, the processing is shown by the following equations.

$$f'(t)=f(t)\ (t{:}\ 0 \text{ to } v-1)$$

$$f'(t)=F+(f(t)-F)*(k-t)/(k-v)\ (t{:}\ v \text{ to } k-1)$$

$$f'(t)=F(t{:}k \text{ or after})$$

A waveform synthesizing means 59 re-synthesizes a harmonic as shown in FIG. 5B (g) on the basis of the corrected amplitude and frequency data. This is shown by the following equation, assuming that the harmonic data is C(t).

$$C(t)=a'(t)*\sin(2\pi f'(t)*t)$$

A mixing means 60 mixes the outputs of the respective harmonic processing means 51 and 52 to output corrected musical tone waveform data.

In the first embodiment, the waveform is corrected by the above processings so that the parameter changes gradually decrease from the rise portion to the beginning of the repetition portion, and thus a natural musical tone having a smoothly changing tone color can be obtained in the electronic musical instrument using such waveform.

Figure 6:
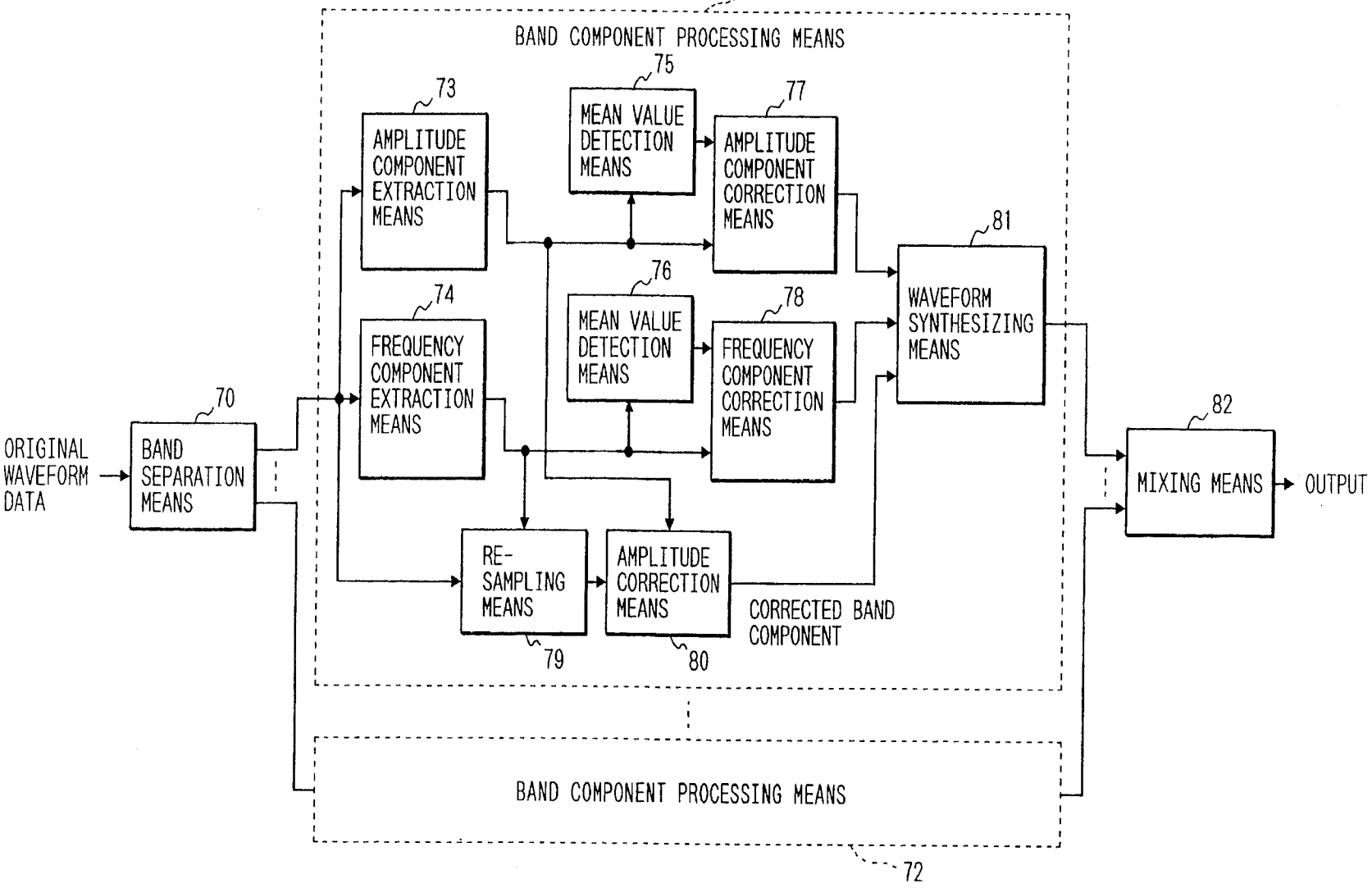
FIG. 6 is a functional block diagram showing another embodiment of the waveform processing apparatus.

FIG. 6 is a functional block diagram showing the functions of the second embodiment of the waveform processing apparatus. The first embodiment has a problem that the amount of data to be processed becomes very large because the processing is performed for each harmonic, but in this embodiment, the amount of data to be processed can be reduced by dividing the original signal by a band divider means into, for instance, wide bands including a plurality of harmonics, and processing them.

A band separation means 70 divides the original signal into, for instance, wide bands including a plurality of harmonics, and outputs each band signal, Harmonics having large levels may be separated independently, and those having small levels may be contained in the same band as the adjacent harmonic having a large level. The number of band component processing means 71 and 72 is equal to the number of the band components, and the respective extracted band components are independently processed by the plurality of band component processing means 71 and 72.

An amplitude component extraction means 73 outputs amplitude component data, for instance, by detecting the amplitude peaks of a band component signal and connecting them by a line. A frequency component extraction means 74 outputs frequency component data by determining the period from the band component signal and calculating the reciprocal of it, but it is not simple to determine the period from the interval between the zero-cross points if a plurality of harmonics are contained. Thus, for instance, by detecting the period between the peaks having the largest amplitude, or obtaining the auto-correlation function of the band signal, the period can be determined from points other than zero which have the largest value.

Mean value detection means 75 and 76 determine the mean value of a predetermined range for the amplitude and frequency components, respectively. An amplitude component correction means 57 outputs corrected amplitude component data by correcting the amplitude component data so that the deviation of the amplitude component data from the mean value is gradually decreased for a predetermined period v to k), and so that the amplitude component data becomes the mean value after a certain time (t=k). A frequency component correction means 78 also outputs corrected frequency component data by correcting the frequency component data so that the deviation of the frequency component data from the mean value is gradually decreased for a predetermined period (t:v to k), and so that the frequency component data becomes the mean value after a certain time (t=k). There processings are the same as the first embodiment.

In this embodiment, the amplitude and frequency components extracted in the respective band component processing means contain, for instance, only the information on the harmonics having the largest level which are contained in the band. Accordingly, to re-synthesize the band signal more faithfully by a waveform synthesizing means 81, it is required to prepare a corrected band component signal including the main harmonics having the largest level contained in the band which is eliminated the parameter change, and other harmonic components contained in the band as they are. And, the band signal is synthesized based on the corrected band component signal. For this, a re-sampling means 79 re-samples the band signal based on the output data (period data) from the frequency extraction means 74. That is, a new sample value is determined by an interporatory operation or the like so that the numbers of samples within the respective periods of the main harmonics are all the same.

In addition, an amplitude correction means 80 determines the maximum value of the absolute values of the amplitudes for each period, and divides each sample value by the maximum value, thereby making the amplitudes the same level for the all periods.

The waveform synthesizing means 81 synthesizes the band signal by using the corrected amplitude and frequency eans, components data output from the respective correction means, and performing the reverse processings of the amplitude correction means 80 and the re-sampling means 79. That is, first, the corrected band component signal is multiplied by the corrected amplitude component data, and the number of samples of each period is increased or decreased by an interporatory operation based on the corrected frequency component data. A mixing means 82 mixes the outputs of the respective band component processing means 71 and 72 to output corrected musical tone waveform data.

As seen from the foregoing, in the second embodiment, the processing can be made with less number of divided bands, and the processing time can thus be shortened. In addition, if the parameters of the harmonics contained in one band are changing in a similar manner, a corrected result similar to the first embodiment is also obtained in the processing according to the second embodiment.

Although the embodiments have been described above, the following variations may be possible.

In the waveform processing apparatus, an arbitrary method can be used as the means for detecting the amplitude and frequency components. For instance, as to the amplitude, a process of performing a detection (to obtain absolute values) and making the signal pass through a low-pass filter may be carried out. Also, as to the detection of the frequency (period) component, there are methods in which it is determined from detection of the periods of zero-cross points or peak points, or from auto-correlation function. In the second embodiment, if the zero-cross points near an expected period are detected, the period can be detected from the zero-cross points.

Although the ranges A, B and C in FIGS. 5A and 5B may be arbitrarily established, C (or k) depends on, for instance, the degree of decrease in the tone color change and the memory capacity which can be utilized as a waveform memory. Since A is the parameter value of the repetitive portion, it may be a predetermined range the center of which is the point k, taking into consideration the continuity at the point k. B may be experimentally determined so that the original sound is not corrected more than necessary and the tone color smoothly changes.

Although, in the embodiments, examples have been shown in which correction is made to both parameters, amplitude and frequency, correction may be made to only one of the parameters. If the functions of the present invention are added to an electronic musical instrument with a sampling function, collected musical tone data can be compressed for storage and utilization, thus reducing the memory capacity.

As described above, the present invention has an advantage that a parameter change can be accurately controlled and how the tone color changes can be arbitrarily controlled, because the original sound is divided into each separate band and processed. In addition, in the electronic musical instrument using a waveform memory storing waveform data processed by the apparatus of the present invention, there is an advantage that the tone color change can be made more natural.

What is claimed is:

1. A waveform processing apparatus comprising:

a band dividing means for dividing an original sound signal into a plurality of frequency bands and outputting band signals, an extraction means for extracting at least one parameter of amplitude and frequency of each band signal, the at least one parameter having parameter variations with time, a parameter correction means for correcting the parameters of each band signal based on a mean of the parameter variations so that the parameter variations gradually decrease from a first time to a second time and disappear after the second time and for providing corrected parameters, a synthesizing means for synthesizing each band signal using the corrected parameters, and a mixing means for mixing each corrected band signal to provide an output.

2. A waveform processing apparatus of claim 1 wherein said extraction means consists of an amplitude component extraction means and a frequency component extraction means, sand said parameter correction means includes:

an amplitude component mean value detection means for detecting the mean value of the amplitude component in a predetermined range, an amplitude component correction means for correcting the amplitude component based on the output data of said amplitude component mean value detection means so that the variation from said amplitude mean value gradually decreases from the first time and equals said amplitude mean value after the second time, and a frequency component mean value detection means for detecting the mean value of the frequency component in a predetermined range, and a frequency component correction means for correcting the frequency component based on the output data of said frequency component mean value detection means so that the variation from said frequency component mean value gradually decreases from the first time and equals said frequency mean value after the second time.

3. A waveform processing apparatus of claim 2 wherein said band dividing means divides the band for each harmonic component of the original sound.

4. The waveform processing apparatus of claim 1 wherein:

said band dividing means for dividing the band so that at least one band contains two or more harmonic components of the original sound, the waveform processing apparatus further comprising:

a band signal correction means for correcting the band signal by the parameters extracted by the extraction means so that the variation of said parameters disappears, and a synthesizing means for synthesizing each band signal by deviating the output signal of said band signal correction means based on the parameters corrected by said parameter correction means.

5. A waveform processing apparatus of claim 4, wherein said extraction means consists of an amplitude component extraction means and a frequency component extraction means, and said parameter correction means includes:

an amplitude component mean value detection means for detecting the mean value of the amplitude component in a predetermined range, an amplitude components correction means for correcting the amplitude component based on the output data of said amplitude component mean value detection means so that the variation from said amplitude mean value gradually decreases from the first time and equals said amplitude mean value after the second time, a frequency component mean value detection means for detecting the mean value of the frequency component in a predetermined range, and a frequency component correction means for correcting the frequency component based on the output data of said frequency component mean value detection means so that the variation from said frequency mean value gradually decreases from the first time and equals said frequency mean value after the second time.

6. An electronic musical instrument having:

a waveform memory having a waveform data stored therein, and a musical tone signal generator means for generating a musical tone by reading out the waveform data from the waveform memory, wherein the waveform data is provided by a waveform processing means, the waveform processing means comprising:

a band dividing means for dividing an original sound signal into a plurality of frequency bands and outputting band signals, an extraction means for extracting at least one parameter of amplitude and frequency of each band signal, the at least one parameter having parameter variations with time, a parameter correcting means for correcting the parameters of each band signal based on a mean of the parameter variations so that the parameter variations gradually decrease from a first time to a second time and disappear after the second time and for providing corrected parameters, a synthesizing means for synthesizing each band signal using the corrected parameters, and a mixing means for mixing each correct band signal to provide the waveform data.

7. An electronic musical instrument of claim 6 wherein the musical tone signal generator means repeatedly reads out waveform data after the second timed when the reading out of waveform reaches the last of waveform data.

8. The electronic musical instrument of claim 6 wherein the at least one band contains two or more harmonic components of the original sound, and wherein the waveform processing apparatus further comprising:

a band signal correction means for correcting the band signal by the parameters extracted by the extraction means so that the variation of said parameters disappears, and a synthesizing means for synthesizing each band signal by deviating the output signal of said band signal correction means based on the parameters corrected by said parameter correction means.

9. The electronic musical instrument of claim 8 wherein the musical tone signal generator means repeatedly reads out waveform data after the second time, when the reading out of waveform reaches the last of waveform data.

10. A method, comprising the steps of:

providing an electronic musical instrument having a waveform memory;

storing a waveform data in the waveform memory, and generating a musical tone by reading out the waveform data from the waveform memory;

wherein the waveform data is provided by a method for waveform processing comprising the steps of:

dividing an original sound signal into a plurality of frequency bands and outputting band signals, extracting at least one parameter of amplitude and frequency of each band signal, the at least one parameter having parameter variations with time, correcting the parameters of each band signal based on a mean of the parameter variations so that the parameter variations gradually decrease from a first time to a second time and disappear after the second time and for providing corrected parameters, synthesizing each band signal using the corrected parameters, and mixing each correct band signal to provide the waveform data.

11. The method of claim 10 wherein at least one band contains two or more harmonic components of the original sound, and wherein the method for waveform processing further comprises the steps of:

correcting the band signal by the parameters extracted by the step for extracting at least one parameter so that the variation of said parameters disappears, and synthesizing each band signal by deviating the output signal of said step for correcting the band signal based on the parameters corrected by said step for correcting the parameters.

* * * * *

UNITED STATES PATENT AND TRADEMARK OFFICE

CERTIFICATE OF CORRECTION

PATENT NO. : 5,597,970

DATED : January 28, 1997

INVENTOR(S) : Sato et al.

It is certified that error appears in the above-indentified patent and that said Letters Patent is hereby corrected as shown below:

Column 4, line 24, in the equation, delete "f" 1st occurrence and insert --f'--.

Column 4, line 25, in the equation, delete "f" 1st occurrence and insert --f'--.

Column 4, line 26, in the equation, delete "f" 1st occurrence and insert --f'--.

Column 4, line 34, in the equation, delete "f" and insert --f'--.

Signed and Sealed this

Eighth Day of July, 1997

Bruce Lehman

*Attest:*

BRUCE LEHMAN

*Attesting Officer*

*Commissioner of Patents and Trademarks*